US008662071B2

(12) United States Patent
Simmons

(10) Patent No.: US 8,662,071 B2
(45) Date of Patent: Mar. 4, 2014

(54) HOUSEHOLD GAS APPLIANCE WITH A MAGNETICALLY CONTROLLED GAS SUPPLY SYSTEM

(75) Inventor: Bruce Simmons, Kinston, NC (US)

(73) Assignee: BSH Home Appliances Corporation, Irvine, CA (US)

( * ) Notice: Subject to any disclaimer, the term of this patent is extended or adjusted under 35 U.S.C. 154(b) by 335 days.

(21) Appl. No.: 13/026,392

(22) Filed: Feb. 14, 2011

(65) Prior Publication Data

US 2012/0204853 A1 Aug. 16, 2012

(51) Int. Cl.
*F24C 3/12* (2006.01)

(52) U.S. Cl.
USPC ..... 126/42; 126/39 BA; 126/39 N; 126/52; 251/65

(58) Field of Classification Search
USPC ..... 126/39 BA, 39 N, 39 R, 42, 52
See application file for complete search history.

(56) References Cited

U.S. PATENT DOCUMENTS 2,021,854 A * 11/1935 Dexter ..... 126/39 R
2,413,237 A 12/1946 Jones
2,566,017 A * 8/1951 Cooley ..... 335/136
2,576,168 A * 11/1951 Allen ..... 137/384.6
2,595,769 A * 5/1952 Cooley ..... 335/136
2,796,489 A 6/1957 Noregaard
2,931,953 A 4/1960 Barney
3,130,719 A * 4/1964 Mayer et al. ..... 126/37 B
3,212,751 A * 10/1965 Hassa ..... 251/65
3,215,903 A 11/1965 Barney
3,556,156 A * 1/1971 Fuller, Jr. ..... 138/43
4,265,612 A * 5/1981 Romanelli et al. ..... 431/66
4,331,013 A * 5/1982 Jaulmes ..... 70/278.2
4,349,042 A * 9/1982 Shimizu ..... 137/39
4,416,127 A * 11/1983 Gomez-Olea Naveda ..... 70/276
4,491,142 A * 1/1985 Shimizu ..... 137/65
4,562,711 A * 1/1986 Fliege ..... 70/276
4,606,339 A * 8/1986 Walther ..... 128/204.19
4,694,860 A * 9/1987 Eidsmore ..... 137/614.21
4,922,888 A * 5/1990 Bryan et al. ..... 126/42

(Continued)

FOREIGN PATENT DOCUMENTS

EP 0497191 8/1992
EP 0600780 6/1994
EP W02005038350 A1 4/2005

OTHER PUBLICATIONS

European Search Report EP 12 15 5124.

(Continued)

*Primary Examiner* — Jorge Pereiro
(74) *Attorney, Agent, or Firm* — James E. Howard; Andre Pallapies

(57) ABSTRACT

A household gas appliance includes a gas supply valve which is operated using a magnetic key. The gas supply valve itself may be magnetically operable. In this instance, when a magnetic key is placed adjacent the magnetically operable gas supply valve, the gas supply valve would open. When the magnetic key is removed, the gas supply valve would close. In other embodiments, a magnetic sensor may sense the presence or absence of a magnetic key. If the magnetic key is present, the magnetic sensor would generate an opening signal which causes the gas supply valve to open. When the magnetic key is removed, the magnetic sensor would generate a closing signal which causes the gas supply valve to close.

20 Claims, 5 Drawing Sheets

(56) References Cited

U.S. PATENT DOCUMENTS

| | | | | |
|---|---|---|---|---|
| 4,983,812 | A | 1/1991 | Worrall et al. | |
| 5,050,640 | A * | 9/1991 | Cowley | 137/606 |
| 5,400,766 | A * | 3/1995 | Dillon | 126/42 |
| 5,920,131 | A | 7/1999 | Platt et al. | |
| 6,000,390 | A | 12/1999 | Evers et al. | |
| 6,131,877 | A * | 10/2000 | Kerger et al. | 251/65 |
| 6,398,183 | B1 * | 6/2002 | Kerger et al. | 251/65 |
| 6,498,326 | B1 | 12/2002 | Knappe | |
| 6,655,652 | B2 * | 12/2003 | Meinhof | 251/65 |
| 6,847,134 | B2 * | 1/2005 | Frissen et al. | 310/12.05 |
| 6,998,585 | B2 | 2/2006 | Erdmann | |
| 7,111,596 | B2 * | 9/2006 | Morin et al. | 123/90.11 |
| 7,401,610 | B1 * | 7/2008 | Cherry | 126/42 |
| 7,446,644 | B2 * | 11/2008 | Schaffzin et al. | 340/5.6 |
| 2003/0183791 | A1 * | 10/2003 | Meinhof | 251/129.04 |
| 2004/0113731 | A1 * | 6/2004 | Moyer et al. | 335/220 |
| 2004/0135573 | A1 * | 7/2004 | Kaltenbach et al. | 324/207.24 |
| 2005/0046531 | A1 * | 3/2005 | Moyer et al. | 335/256 |
| 2005/0199198 | A1 * | 9/2005 | Morin et al. | 123/90.11 |
| 2005/0224066 | A1 * | 10/2005 | Li | 126/39 BA |
| 2006/0164208 | A1 * | 7/2006 | Schaffzin et al. | 340/5.64 |
| 2007/0205231 | A1 * | 9/2007 | Haul | 222/544 |
| 2008/0278354 | A1 * | 11/2008 | Garrett | 341/32 |
| 2008/0290990 | A1 * | 11/2008 | Schaffzin et al. | 340/5.64 |
| 2010/0012647 | A1 | 1/2010 | Baier et al. | |
| 2010/0280670 | A1 * | 11/2010 | Haul | 700/283 |
| 2012/0111434 | A1 * | 5/2012 | Cadeau et al. | 137/597 |
| 2012/0118280 | A1 * | 5/2012 | Cadeau et al. | 126/52 |
| 2012/0132836 | A1 * | 5/2012 | Cadeau et al. | 251/65 |

OTHER PUBLICATIONS

Siemens-Electrogerate GmbH, "Siemens discControl for Appliances", 2009, http://www.siennens-home.de; http://www.unplgged.com.

Higgins, "Electric cooktops with a twist (by BSH Home Appliances Corp.)", http://www.machinedesign.com, Oct. 9, 2003.

* cited by examiner

HOUSEHOLD GAS APPLIANCE WITH A MAGNETICALLY CONTROLLED GAS SUPPLY SYSTEM

BACKGROUND OF THE INVENTION

Gas ranges and gas cooktops used for cooking typically include a plurality of gas burners which receive gas from a gas supply manifold. Individual control valves are typically used to control the flow of gas from the gas supply manifold to each of the gas burners.

Gas ranges and gas cooktops may include an internal gas supply valve which controls the flow of gas from a supply line into the gas manifold. The gas supply valve may also control the flow of gas to other portions of the appliance, such as burners or heaters located within an oven or broiling portion of the appliance.

The gas supply valve of a cooking appliance may be manually or electrically controlled. In some instances, a controller of the appliance sends a control signal to the gas supply valve to open or shut the valve. The user may be able to press buttons on a control panel of the appliance to cause the gas supply valve to open and/or to close.

BRIEF SUMMARY OF THE INVENTION

A first aspect of the invention may be embodied in a household gas appliance that includes a gas supply manifold, at least one gas burner, and at least one control valve, each control valve controlling a flow of gas from the gas supply manifold to one of the gas burners. The household gas appliance also includes a gas supply valve that controls a flow of gas into the gas supply manifold. The gas supply valve can be switched between open and closed positions using a magnetic key. When the magnetic key is located in a first position on the appliance, the gas supply valve is switched to the open position. When the magnetic key is removed from the first position, the gas supply valve is switched to the closed position.

A second aspect of the invention may be embodied in household gas appliance that includes a gas supply valve and a magnetic key. The gas supply valve is configured to be coupled to a gas supply line. The appliance is configured such that when the magnetic key is located in a first position, the gas supply valve opens so that gas can flow through the valve. When the magnetic key is removed from the first position, the gas supply valve closes to prevent gas from flowing though the gas supply valve.

In some embodiments, the gas supply valve may be magnetically operable so that the presence or absence of a magnetic field generated by the magnetic key causes the gas supply valve to open and close.

In some embodiments, the gas supply valve may be electrically operable. In such embodiments, a magnetic sensor may detect the presence or absence of a magnetic field generated by a magnetic key, and the magnetic sensor would then generate control signals that cause the gas supply valve to open and close.

Some embodiments may also include a controller that is coupled to a user operable input keypad. The user may be able to input codes with the keypad to cause a gas supply valve to open or close regardless of whether a magnetic key is present or absent.

A magnetic key used to control a gas supply valve may be configured to output a predetermined magnetic field pattern, and a corresponding magnetic sensor may be able to detect magnetic field patterns. If the magnetic sensor does not detect the correct magnetic field pattern, the magnetic sensor may not generate an opening signal.

In some embodiments, the magnetic key and the magnetic sensor may come into direct contact with each other. In other embodiments, the magnetic key may be separated from the magnetic sensor by a surface of the appliance.

In some embodiments, the magnetic key is located on the appliance in a position that is visible to the user. In other embodiments, the magnetic key may be located in a position that is not directly observable by a user.

DETAILED DESCRIPTION OF THE INVENTION

Figure 1:
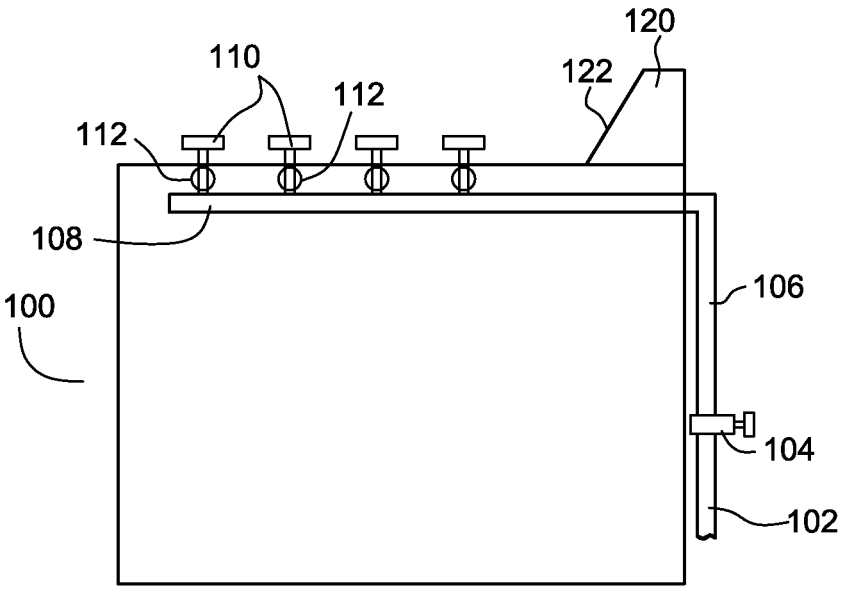
FIG. 1 is a side view of a gas range.
Figure 2:
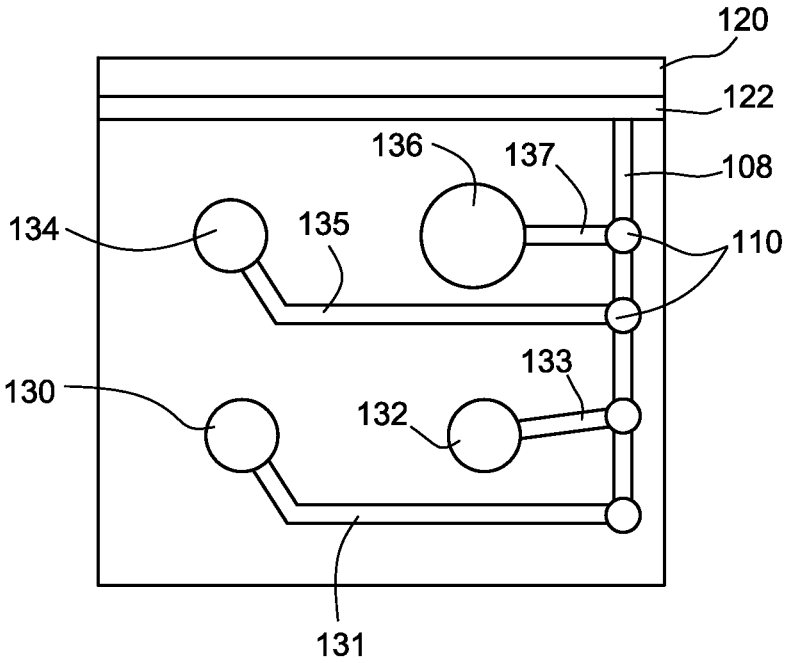
FIG. 2 is a top view of the gas range illustrated in FIG. 1.

A typical gas range and oven combination is illustrated in FIGS. 1 and 2. As shown in FIG. 1, a gas supply line 102 is coupled to first side of a gas cut off valve 104, and the second side of the gas cut off valve is coupled to a gas supply line that runs into the appliance. The gas cut off valve 104 can be shut so that the gas range 100 can be removed or replaced.

The gas supply line 106 runs to a gas supply manifold 108 inside the appliance, which delivers gas to a plurality of gas burners, as illustrated in FIG. 2. A plurality of control valves 112 are coupled to the gas supply manifold 108. Each control valve 112 is operated by a control knob 110. Gas supply lines 131, 133, 135, 137 run from each of the control valves 112 to corresponding gas burners 130, 132, 134, 136. As a result, the user is able to individually control the gas running to each of the burners of the gas range 100.

Although not illustrated, the gas supply line 106 may also supply gas to other burners or heating elements within the appliance, such as heating elements used to heat an oven or broiler.

FIGS. 1 and 2 also illustrate that a control panel enclosure 120 is mounted at the top, rear of the appliance. A control panel 122 is mounted on the front of the control panel enclosure 120. The control panel 122 may include a variety of control buttons and displays which allow a user to control the appliance.

Figure 3:
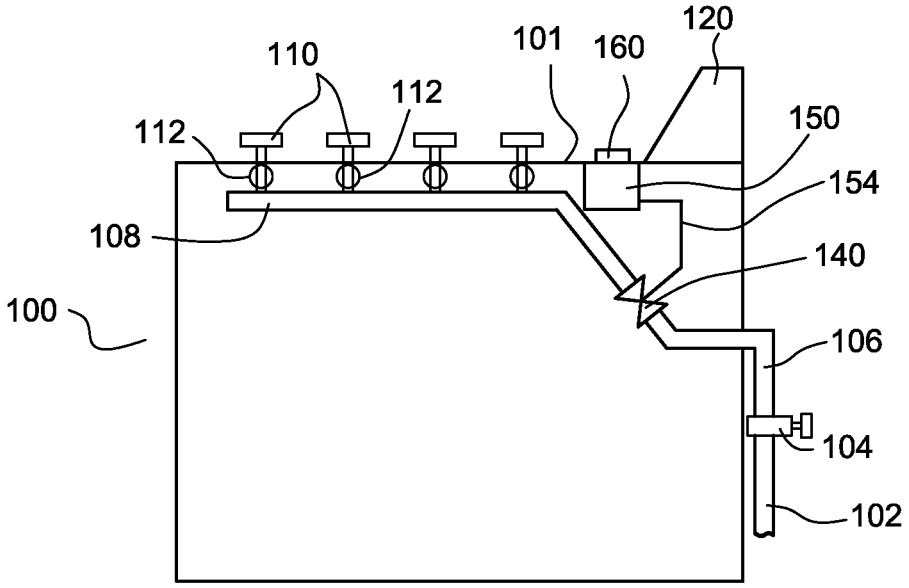
FIG. 3 is a side view of a gas range which includes an electrically operable gas supply valve.

FIG. 3 illustrates a similar gas range, however, this range also includes a gas supply valve 140 connected between the gas supply line 106 and the gas supply manifold 108. The gas supply valve 140 can be used to selectively shut off the supply of gas to the gas supply manifold 108.

In the embodiment illustrated in FIG. 3, a magnetic sensor 150 is mounted underneath a top surface 101 of the gas range 100. The magnetic sensor 150 supplies a control signal to the gas supply valve 140 via a control line 154 to cause the gas supply valve 140 to open and close.

A magnetic key 160 is placed on the top surface 101 of the gas range 100 at a first position which is located adjacent to the magnetic sensor 150. The magnetic key 160 generates a magnetic field which is detected by the magnetic sensor 150. When the magnetic sensor 150 detects the magnetic field generated by the magnetic key 160, the magnetic sensor sends an opening signal to the gas supply valve 140, via the control line 154, to cause the gas supply valve 140 to open and to supply gas to the gas supply manifold 108.

If a user removes the magnetic key 160 from the top surface 101 of the gas range, the magnetic sensor 150 no longer detects a magnetic field. As a result, the magnetic sensor 150 sends a closing signal to the gas supply valve 140 via the control line 154. The closing signal instructs the gas supply valve 140 to close, thereby cutting off the gas supply to the gas supply manifold 108.

With an arrangement as illustrated in FIG. 3, and as described above, it is easy for a user of the appliance to turn off the gas supply by simply removing the magnetic key 160 from the top surface 101 of the gas range. A user can then store or hide the magnetic key 160 in a different location to prevent others from using the gas range. This could be particularly valuable for a parent wishing to cut off the supply of gas to the gas range to prevent a child from deliberately or inadvertently using the range when adults are not present.

Although FIG. 3 illustrates the magnetic sensor 150 and the magnetic key 160 located toward the rear of the gas range, the magnetic sensor 150 and the magnetic key 160 could be placed at any location on the gas range.

In addition, FIG. 3 illustrates an embodiment where the magnetic sensor 150 is located under the top surface 101 of the range, and where the magnetic key 160 is placed on a top surface 101 of the range adjacent or over top of the magnetic sensor 150. In alternate embodiments, the magnetic sensor and the magnetic key might not be separated by an exterior surface of the gas range. For example, the magnetic sensor 150 could be located above the top surface 101 of the range and the magnetic key 160 could be placed directly onto the magnetic sensor 150.

Figure 4:
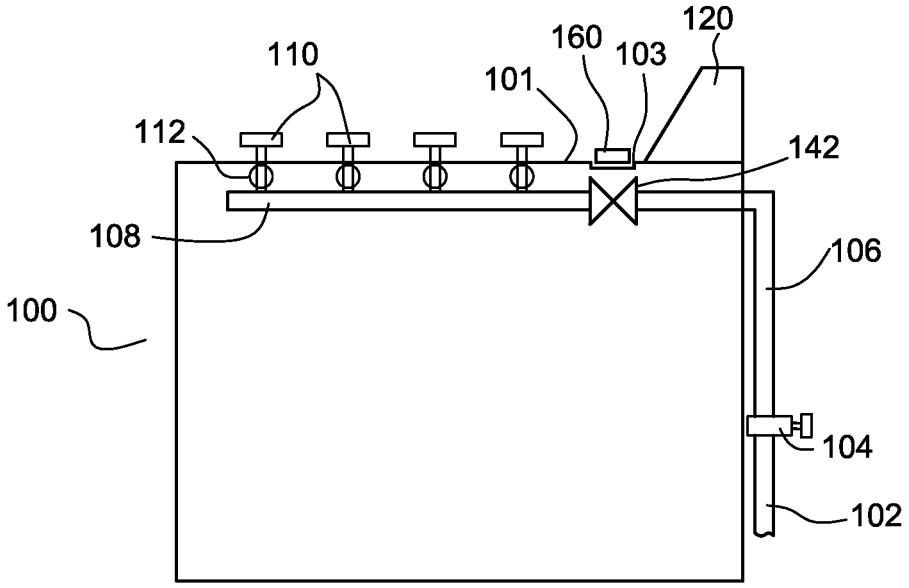
FIG. 4 is a side view of a gas range which includes a magnetically operable gas supply valve.

FIG. 4 illustrates an alternate embodiment which includes a magnetically operable gas supply valve 142. In this embodiment, the magnetically operable gas supply valve 142 is located underneath the top surface 101 of the range. The magnetic key 160 is placed on the top surface 101 of the range at a first position located immediately adjacent the magnetically operable gas supply valve 142.

In the embodiment illustrated in FIG. 4, a depression 103 is formed on the top surface 101 of the range. The magnetic key 160 is located in that depression 103. The depression helps to keep the key out of the way of the user, and it also helps to prevent the magnetic key 160 from being inadvertently moved out of the first position where it causes the magnetically operable gas supply valve 142 to remain open. In addition, the depression 103 may serve to bring the magnetic key closer to the magnetically operable gas supply valve 142. The depression may also help to shield the magnetic key from the heat of the burners. Still further, the depression can help to shield the magnetic key from view.

The magnetic key and any associated depression are preferably located in a remote position so that the magnetic key will not interfere with the use of the gas burners. Also, locating the magnetic key in a remote position can help to shield the magnetic key from view, and help to shield the magnetic key from the heat of the burners.

The magnetically operable gas supply valve 142 may include a mechanism which reacts to a magnetic field generated by the magnetic key 160. When the magnetic key 160 is located immediately adjacent the magnetically operable gas supply valve 142, the magnetic field generated by the magnetic key 160 causes the gas supply valve 142 to open to supply gas to the gas supply manifold 108. If the magnetic key 160 is removed from the depression 103, and no magnetic field is present adjacent the magnetically operable gas supply valve 142, a biasing element within the gas supply valve 142 causes the gas supply valve to close, thereby cutting off the supply of gas to the gas supply manifold 108.

With an arrangement as described above, the user of the range can remove the magnetic key to cause the magnetically operable gas supply valve 142 to close. Here again, this could be useful for a parent who wishes to disable the range to prevent a child from using the range without adult supervision. Because the magnetically operable gas supply valve 142 includes a biasing element which biases the supply valve into the closed position, there is no need for any control signals or controller to cause the gas supply valve 142 to open and close. In fact, there is not even a need for electrical power to allow the range to operate.

Figure 5:
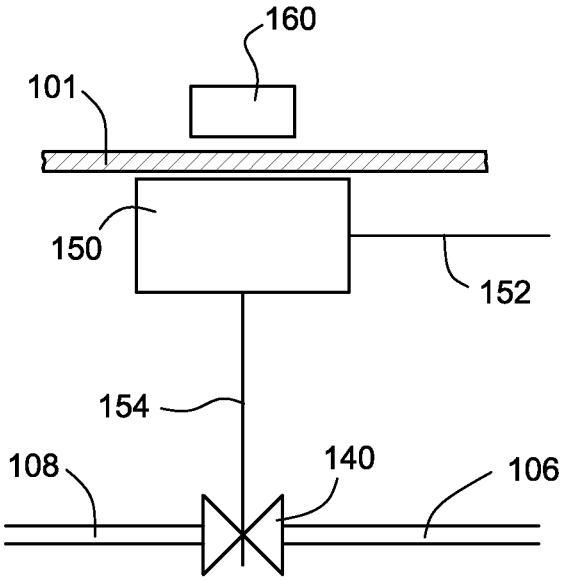
FIG. 5 is a diagram illustrating elements of a control system for controlling a gas supply valve of a gas range.

FIG. 5 illustrates a first embodiment of a control system which can be used to control the supply of gas to the gas supply manifold of a gas range. This system includes a magnetic sensor 150 mounted underneath the top surface 101 of a range. A power line 152 supplies power to the magnetic sensor 150. A control line 154 couples the magnetic sensor 150 to an electrically operated gas supply valve 140. The gas supply valve is connected to a gas supply line 106 which supplies gas, and to a gas supply manifold 108 which is connected to the individual burners or heating elements of the range.

When the magnetic key 160 is placed on the top surface of the range, a magnetic field generated by the magnetic key 160 is detected by the magnetic sensor 150. When the magnetic sensor 150 detects the magnetic field generated by the magnetic key 160, the magnetic sensor generates an opening signal which is coupled to the gas supply valve 140 through the control line 154. The opening signal causes the gas supply valve 140 to open.

Conversely, if the magnetic key 160 is removed from the top surface of the range, and the magnetic sensor 150 no longer detects a magnetic field, the magnetic sensor 150 applies a closing signal to the gas supply valve 140 through the control line 154. The closing signal causes the gas supply valve 140 to close.

In some embodiments, the opening signal could be a predetermined positive or negative voltage which is applied to the gas supply valve 140 to cause an electrically operated mechanism within the gas supply valve 140 to open the gas supply valve. The closing signal could be a different voltage signal, or a zero voltage signal—essentially the absence of a signal.

The gas supply valve 140 could include a biasing element which biases the gas supply valve 140 into the closed position unless an opening signal is applied to the gas supply valve 140 through the control line 154. When configured in this fashion, the gas supply valve will automatically close unless a predetermined opening signal is applied to the gas supply valve. This would act as a safety mechanism which deactivates the gas range whenever a power outage occurs.

If the control system and gas supply valve is configured as described above, whenever a power outage occurs, the range would be inoperable. For this reason, it may be advantageous to utilize a magnetically operable gas supply valve, as depicted in FIG. 4. When the magnetic field of the magnetic key 160 is all that is required to cause the gas supply valve to open, the gas range would likely remain operational during a power outage.

Figure 6:
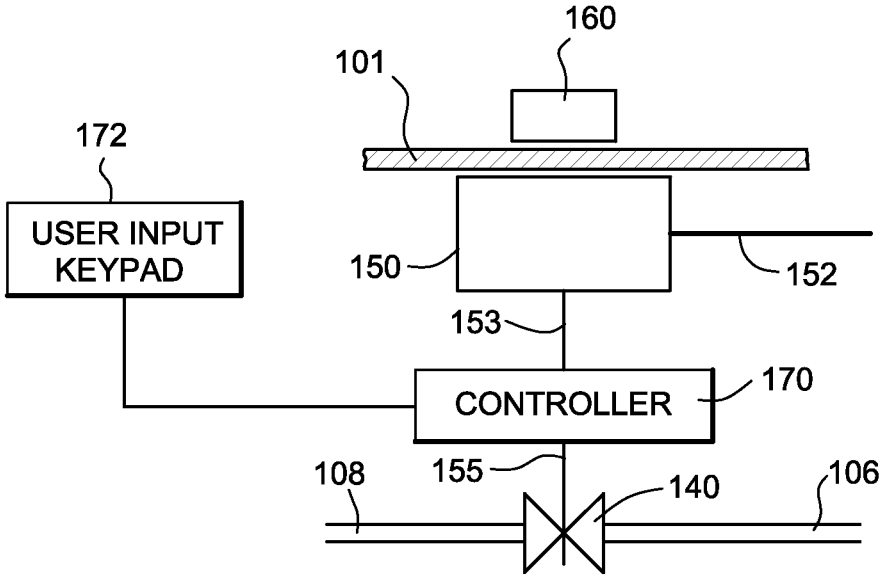
FIG. 6 illustrates elements of an alternate control system for controlling a gas supply valve of a gas range.

FIG. 6 illustrates an alternate embodiment of a control system which also includes a controller 170. In this embodiment, when the magnetic key 160 is located adjacent to the magnetic sensor 150, the magnetic sensor 150 sends an opening signal to the controller 170 via a signal line 153. The controller 170 then sends an opening signal to the gas supply valve 140 through a control line 155. When the magnetic key 160 is removed from the top surface 101 of the range, and the magnetic sensor 150 no longer detects the magnetic field, the magnetic sensor 150 sends a closing signal to the controller 170 through the signal line 153. The controller 170 may then send a closing signal to the gas supply valve 140 through the control line 155.

The use of a controller 170 interposed between the magnetic sensor 150 and the gas supply valve 140 allows a user to override the signals being output by the magnetic sensor 150. For example, if a user has lost the magnetic key 160, the user may be able to input a special control code via an input keypad 172 which instructs the controller 170 to send an opening signal to the gas supply valve 140, even though the controller 170 is receiving a closing signal from the magnetic sensor 150 indicating that the magnetic key is not present. In addition, a user may be able to input a special code or some instructions via the input keypad 172 to instruct the controller to cause the gas supply valve to close, regardless of the signals being received from the magnetic sensor 150. This allows a user to lock the gas supply valve in the closed position, even when the magnetic key 160 is present on the top surface 101 of the range.

Figure 7:
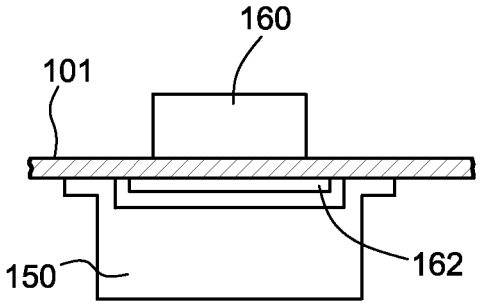
FIG. 7 is a diagram illustrating a magnetic sensor and magnetic key which can be used to control a gas supply valve of a gas range.

FIG. 7 illustrates a magnetic sensor 150 positioned underneath a top surface 101 of the range. In this embodiment, a magnetic steel plate 162 is positioned underneath the top surface 101 of the range at the position where the magnetic key 160 is to be placed.

If the top surface 101 of the range is made of a material which is non-magnetic, such as stainless steel, glass or some other synthetic materials, it may be necessary to mount a magnetic material plate 162 underneath the top surface 101 of the range to ensure that the magnetic key 160 will be held in position. Such a magnetic material plate may also be required to allow the magnet to generate a magnetic field that can be sensed by the magnetic sensor 150. The use of a magnetic material plate 162 as illustrated in FIG. 7 may not be necessary when the top surface 101 of the range it is made of a magnetic material.

Figure 8:
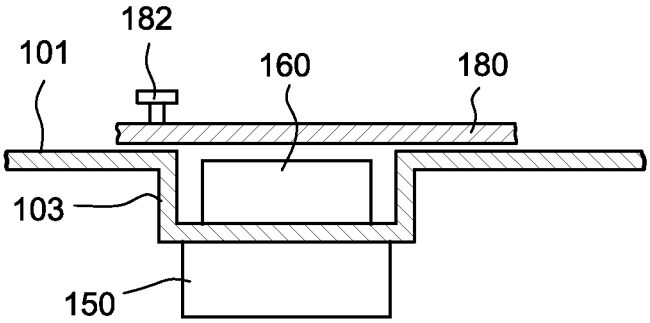
FIG. 8 is a side view illustrating an alternate embodiment of the elements which can be used to magnetically control a gas supply valve of a gas range.

FIG. 8 illustrates an embodiment where a depression 103 is formed on the top surface 101 of the range. The depression 103 is configured to receive the magnetic key 160. The magnetic sensor 150 is then positioned adjacent to the depression 103. In the embodiment illustrated in FIG. 8, the magnetic sensor 150 is positioned underneath a bottom surface of the depression 103. In alternate embodiments, the magnetic sensor 150 could be positioned on a side surface of the depression.

When the magnetic key 160 is located in a depression 103, as illustrated in FIG. 8, the magnetic key is less likely to be accidentally moved out of position by a user. When the top surface 101 of the range is made from a non-magnetic material, the magnetic key will not be attracted to the top surface. In those instances, the use of a depression 103 will help to hold the magnetic key 160 in position over top of the magnetic sensor 150.

Moreover, when a depression 103 is formed to receive the magnetic key, a cover member 180 can be mounted over top of the depression 103. As shown in FIG. 8, a cover member 180 can be movably mounted on the top surface 101 of the range. The cover member 180 may include a knob 182 which can be manipulated by a user to move the cover 180 into different positions.

The cover 180 could be slid or pivoted to a position which exposes the depression 103, which would allow a user to place the magnetic key 160 into the depression 103, or to remove the magnetic key from the depression 103. The user could then move the cover 180 into the position illustrated in FIG. 8, where the cover 180 covers the depression 103 and the magnetic key 160. The cover would further serve to prevent the magnetic key 160 from being accidentally removed. The cover may also protect the magnetic key from food or heated liquids present on the top of the range. Moreover, the use of a cover 180 may help to hide the magnetic key 160 from people viewing the top surface of the range.

If a parent wishes to selectively disable the gas range by removing and hiding the magnetic key 160, keeping the magnetic key 160 hidden during normal use may serve a valuable function. If small children do not typically see the magnetic key 160 during normal operations of the gas range, the children may never be aware that the magnetic key is required to enable use of the range. Thus, the use of a cover 180 which hides the magnetic key 160 in a depression can also be useful in preventing children from learning how to activate the gas range.

Figure 10A:
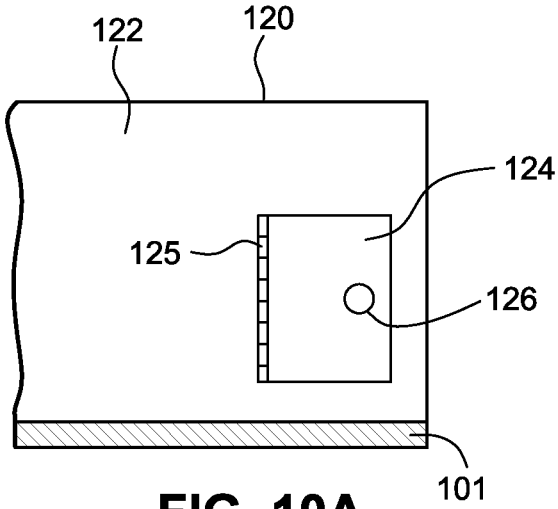
FIG. 10A is a front view of a portion of a control panel enclosure of a gas range.
Figure 10B:
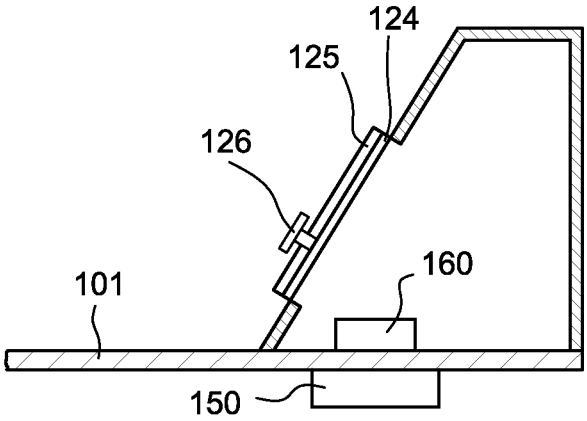
FIG. 10B is a sectional side view of the control panel enclosure illustrated in FIG. 10A.

FIGS. 10A and 10B illustrate an alternate embodiment where the magnetic key is also hidden during normal use. As illustrated in FIGS. 10A and 10B, the control panel enclosure 120 on the top surface 101 of the range could include a moveable member or door 124 which is mounted on the control panel 122 by a hinge 125. A knob 126 on the door 124 could be used to open the door so that a user could place the magnetic key 160 inside the control panel enclosure 120, as illustrated in FIG. 10B.

In this embodiment, the magnetic sensor 150 is mounted underneath the top surface 101 of the range at a position underneath the control panel enclosure 120. The magnetic key 160 would normally reside inside the control panel enclosure 120 at a position over top of the magnetic sensor 150, as illustrated in FIG. 10B. This would keep the magnetic key 160 hidden from use during normal operations. The movable member or door 124 might also be lockable in the closed position to prevent unauthorized users from accessing the interior of the control panel 120 to either remove the magnetic key 160 or to insert the magnetic key 150 to turn on the gas supply.

Although the embodiment illustrated in FIGS. 10A and 10B shows a door hinged onto the control panel 122, in alternate embodiments the door could be slidable, or it could simply be removed to allow a magnetic key to be inserted into or removed from the control panel enclosure.

The magnetic key 160 could take a variety of different forms. In simple embodiments, the magnetic key could simply be a bar or horseshoe magnetic having North and South poles. The magnet may be encapsulated in an inert, durable material such as ceramics, plastic or other synthetics.

The magnetic sensor 150 could simply detect the presence of a magnetic field when the magnetic key 160 is located at a first position adjacent the magnetic sensor. The magnetic sensor could be configured to generate an opening signal only when the magnetic field strength rises above a predetermined threshold level.

Figure 9:
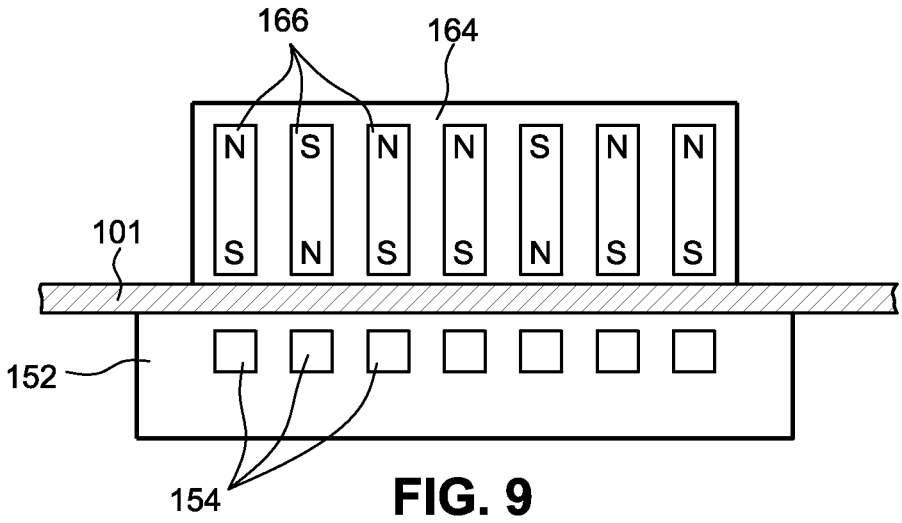
FIG. 9 illustrates a magnetic key and a corresponding magnetic sensor which can be used to control a gas supply valve of a gas range.

In alternate embodiments, as illustrated in FIG. 9, the magnetic key 164 could include a plurality of magnets 166 which are arranged within the magnetic key 164 according to a predetermined pattern. As a result, the magnetic key 164 would generate a predetermined magnetic field pattern.

The magnetic sensor 152 could also include a plurality of magnetic field sensor elements 154 which are designed to detect the predetermined magnetic field pattern generated by the magnetic key 164. The magnetic sensor 152 might only output an opening signal if it senses a predetermined magnetic field pattern. In this instance, it would be necessary for a user to place a magnetic key 164 that generates the correct magnetic field pattern onto the top surface 101 of the range to cause the magnetic sensor 152 to generate an opening signal. If the magnetic key is placed at an improper position, or in an improper orientation, the magnetic sensor 152 would not sense the predetermined magnetic field pattern, and no opening signal would be generated.

The use of a magnetic sensor 152 configured to detect a predetermined magnetic field pattern could also be useful in helping to prevent unauthorized users from causing the gas supply valve to open. For example, if a child, or unauthorized user simply obtained a common magnet and placed it in the proper position, the magnet would not generate the predetermined magnet field pattern required to cause the magnetic sensor to generate an opening signal.

In many of the embodiments described above, the magnetic sensor is positioned under the top surface of the range, which helps to shield the magnetic sensor from food and liquids which may be present on the top of the range. The magnetic key is positioned on top of the top surface of the range to allow easy access to the magnetic key. The magnetic sensor then senses a magnetic field generated by the magnetic key through the top surface of the range.

In alternate embodiments, the magnetic key and magnetic sensor may not be separated from one another by a surface of the range. For instance, when the magnetic key is to be located within an enclosure on the range, as in the embodiment illustrated in FIGS. 10A and 10B, the magnetic sensor may also be mounted within the same enclosure. In this instance, the magnetic key could be placed in direct contact with the magnetic sensor.

When the magnetic key is to be placed in direct contact with the magnetic sensor, both items could be located above the top surface of the range, below the top surface of the range, within an enclosure on the range, or at virtually any position on the range.

FIG. 4 illustrates one embodiment where the gas supply valve itself is caused to open and close based on the presence or absence of a magnetic field generated by a magnetic key. This embodiment illustrates the magnetically operated gas supply valve positioned under the top surface 101 of the range so that a magnetic key can be placed on the top surface 101 to cause the gas supply valve to open. In alternate embodiments, the gas supply valve could be located at different positions. Also, the magnetic key might be placed in direct contact with the gas supply valve.

In the embodiments described above, a magnetic key is used to cause a gas supply valve of a gas range to open and close. However, the same type of control system could be used with other gas appliances or gas powered devices. For example, the same type of control system could be used with standalone gas cooktop, or with any type of gas cooktop. Such a control system could also be used on a gas powered clothing dryer, a gas powered hot water heater, or any other appliance or device that makes use of gas.

Likewise, the same type of control system could be used to control any type of fluid valve. For instance, the same type of control system could be used to control a water supply valve of an appliance, such as a dishwasher, a clothing washer, an ice maker or any other appliance that makes user of water.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A household gas appliance, comprising:

a gas supply valve that is configured to be coupled to a gas supply line; and a magnetic key, wherein when the magnetic key is located in a first position, the gas supply valve opens so that gas can flow through the valve, and wherein when the magnetic key is removed from the first position, the gas supply valve closes to prevent gas from flowing though the valve, wherein the first position is not normally visible to a user of the appliance such that a user cannot normally see the magnetic key when it is located at the first position, the first position being located inside an enclosure on the appliance; and a magnetic sensor that detects when the magnetic key is located in the first position, wherein when the magnetic sensor detects that the magnetic key is located in the first position, the magnetic sensor outputs an opening signal that causes the gas supply valve to open, and wherein when the magnetic sensor detects that the magnetic key is not located in the first position, the magnetic sensor outputs a closing signal that causes the gas supply valve to close.

2. The household gas appliance of claim 1, wherein the gas supply valve includes a biasing member that biases the gas supply valve closed.

3. The household gas appliance of claim 2, wherein when the magnetic key is located in the first position, a magnetic field generated by the magnetic key causes the gas supply valve to open against the force of the biasing member.

4. The household gas appliance of claim 3, wherein when the magnetic key is removed from the first position, thereby removing the magnetic field generated by the magnetic key, the biasing member causes the gas supply valve to close.

5. The household gas appliance of claim 1, further comprising a controller coupled to the magnetic sensor and the gas supply valve, wherein when the magnetic sensor outputs the opening signal to the controller, the controller causes the gas supply valve to open, and wherein when the magnetic sensor outputs the closing signal to the controller, the controller causes the gas supply valve to close.

6. The household gas appliance of claim 1, wherein the magnetic key generates a magnetic field having a predetermined pattern, wherein the magnetic sensor is located adjacent the first position, and wherein when the magnetic sensor detects a magnetic field having the predetermined pattern, the magnetic sensor causes the gas supply valve to open.

7. The household gas appliance of claim 6, wherein the magnetic key includes a plurality of magnets that generate North and South magnetic fields having the predetermined pattern.

8. The household gas appliance of claim 6, wherein if the magnetic sensor detects a magnetic field that does not match the predetermined pattern, the magnetic sensor will not cause the gas supply valve to open.

9. A household gas appliance, comprising:

a gas supply manifold;

at least one gas burner;

at least one control valve, each control valve controlling a flow of gas from the gas supply manifold to a gas burner;

a gas supply valve that controls a flow of gas into the gas supply manifold, wherein the gas supply valve can be switched between open and closed positions;

a magnetic key, wherein when the magnetic key is located in a first position on the household gas appliance, the gas supply valve is switched to the open position, wherein when the magnetic key is removed from the first position, the gas supply valve is switched to the closed position, wherein the first position is not normally visible to a user of the appliance such that a user cannot normally see the magnetic key when it is located at the first position, the first position being located inside an enclosure on the appliance; and a magnetic sensor that detects when the magnetic key is located in the first position, wherein when the magnetic sensor detects that the magnetic key is located in the first position, the magnetic sensor outputs an opening signal that causes the gas supply valve to open, and wherein when the magnetic sensor detects that the magnetic key is not located in the first position, the magnetic sensor outputs a closing signal that causes the gas supply valve to close.

10. The household gas appliance of claim 9, further comprising a movable member that can move to open the enclosure so that the magnetic key can be placed at the first position or removed from the first position.

11. The household gas appliance of claim 9, wherein the magnetic key includes a plurality of magnets that generate a predetermined pattern of North and South magnetic fields, and wherein the magnetic sensor is configured to detect the predetermined magnetic field pattern.

12. The household gas appliance of claim 11, wherein if the magnetic sensor does not detect the predetermined magnetic field pattern, the magnetic sensor will not output an opening signal.

13. A household gas appliance, comprising:

a gas supply manifold;

at least one gas burner;

at least one control valve, each control valve controlling a flow of gas from the gas supply manifold to a gas burner;

a gas supply valve that controls a flow of gas into the gas supply manifold, wherein the gas supply valve can be switched between open and closed positions;

a magnetic key, wherein when the magnetic key is located in a first position on the household gas appliance, the gas supply valve is switched to the open position, wherein when the magnetic key is removed from the first position, the gas supply valve is switched to the closed position, wherein a depression is formed on the appliance at the first position, the depression being configured to receive the magnetic key when it is located in the first position;

a magnetic sensor that detects when the magnetic key is located in the first position, wherein when the magnetic sensor detects that the magnetic key is located in the first position, the magnetic sensor outputs an opening signal that causes the gas supply valve to open, and wherein when the magnetic sensor detects that the magnetic key is not located in the first position, the magnetic sensor outputs a closing signal that causes the gas supply valve to close; and a cover on the appliance that moves between an open position which exposes the depression and a closed position which closes the depression.

14. The household gas appliance of claim 13, wherein the gas supply valve is magnetically operable, wherein the gas supply valve is located adjacent the first position such that when the magnetic key is located in the first position, a magnetic field generated by the magnetic key causes the gas supply valve to open, and such that when the magnetic key is not located in the first position, the gas supply valve closes.

15. The household gas appliance of claim 13, wherein the first position is not normally visible to a user of the appliance such that a user cannot normally see the magnetic key when it is located at the first position.

16. The household gas appliance of claim 15, wherein the first position is located inside an enclosure on the appliance.

17. The household gas appliance of claim 16, wherein the cover comprises a movable member that can move to open the enclosure so that the magnetic key can be placed at the first position or removed from the first position.

18. The household gas appliance of claim 13, wherein the magnetic key includes a plurality of magnets that generate a predetermined pattern of North and South magnetic fields, and wherein the magnetic sensor is configured to detect the predetermined magnetic field pattern.

19. The household gas appliance of claim 18, wherein if the magnetic sensor does not detect the predetermined magnetic field pattern, the magnetic sensor will not output an opening signal.

20. The household gas appliance of claim 13, further comprising a controller coupled to the magnetic sensor and the gas supply valve, wherein when the controller receives the opening signal from the magnetic sensor, the controller causes the gas supply valve to open, and wherein when the controller receives the closing signal from the magnetic sensor, the controller causes the gas supply valve to close.

* * * * *